US010835780B2

(12) United States Patent
Mese et al.

(10) Patent No.: US 10,835,780 B2
(45) Date of Patent: Nov. 17, 2020

(54) ACTIVITY TRACKING

(71) Applicant: Lenovo (Singapore) Pte. Ltd., Singapore (SG)

(72) Inventors: John Carl Mese, Cary, NC (US); Russell Speight VanBlon, Raleigh, NC (US); Nathan J. Peterson, Oxford, NC (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 168 days.

(21) Appl. No.: 15/673,003

(22) Filed: Aug. 9, 2017

(65) Prior Publication Data

US 2019/0046838 A1 Feb. 14, 2019

(51) Int. Cl.
*A63B 24/00* (2006.01)
*G07C 1/22* (2006.01)

(52) U.S. Cl.
CPC ..... *A63B 24/0062* (2013.01); *A63B 24/0021* (2013.01); *G07C 1/22* (2013.01); *A63B 2024/0025* (2013.01); *A63B 2220/17* (2013.01); *A63B 2220/62* (2013.01)

(58) Field of Classification Search
CPC ..... A68B 24/0062; A68B 24/0021; A63B 2024/0025; A63B 2220/17; A63B 2220/62; G07C 1/22
See application file for complete search history.

(56) References Cited

U.S. PATENT DOCUMENTS 8,021,297 B2 * 9/2011 Aerts ..... A61B 5/0205 600/300
2017/0266531 A1 * 9/2017 Elford ..... A63B 24/0062
2017/0281079 A1 * 10/2017 Nachman ..... A61B 5/4866
2017/0353833 A1 * 12/2017 de Barros Chapiewski ..... G08B 13/1427
2017/0354845 A1 * 12/2017 Williams ..... G06T 11/60
2018/0190382 A1 * 7/2018 Ramezani ..... H04L 67/22
2018/0284959 A1 * 10/2018 Alphin, III ..... G06F 11/3438

* cited by examiner

*Primary Examiner* — Catherine T. Rastovski
(74) *Attorney, Agent, or Firm* — Ference & Associates LLC

(57) ABSTRACT

One embodiment provides a method, including: receiving, at an information handling device, an indication that a user is engaging in an activity; determining, using a processor, whether data related to the activity is associated with a tracking application; and prompting, responsive to determining that data related to the activity is associated with a tracking application, the user to provide information related to the activity. Other aspects are described and claimed.

15 Claims, 4 Drawing Sheets

ACTIVITY TRACKING

BACKGROUND

Advances in technology have enabled information handling devices ("devices"), for example smart phones, tablet devices, laptop and personal computers, smart watches, other wearable devices, and the like, to track and record user activity data. For example, many wearable devices are dedicated fitness trackers (e.g., Fitbit®, Samsung Gear®, Jawbone®, etc.), or comprise fitness tracking software (e.g., Apple Watch®, other smart watches, etc.), that are capable of accurately tracking a user's daily activities and/or biometric data (e.g., steps taken, stairs climbed, calories burned, heart rate, etc.). The gathered activity data can be monitored throughout the day by a user and/or stored in an accessible database for future reference.

BRIEF SUMMARY

In summary, one aspect provides a method, comprising: receiving, at an information handling device, an indication that a user is engaging in an activity; determining, using a processor, whether data related to the activity is associated with a tracking application; and prompting, responsive to determining that data related to the activity is associated with a tracking application, the user to provide information related to the activity.

Another aspect provides an information handling device, comprising: a processor; a memory device that stores instructions executable by the processor to: receive an indication that a user is engaging in an activity; determine whether data related to the activity is associated with a tracking application; and prompt, responsive to determining that data related to the activity is associated with a tracking application, the user to provide information related to the activity.

A further aspect provides a product, comprising: a storage device that stores code, the code being executable by a processor and comprising: code that receives an indication that a user is engaging in an activity; code that determines whether data related to the activity is associated with a tracking application; and code that prompts, responsive to determining that data related to the activity is associated with a tracking application, the user to provide information related to the activity.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

Figure 1:
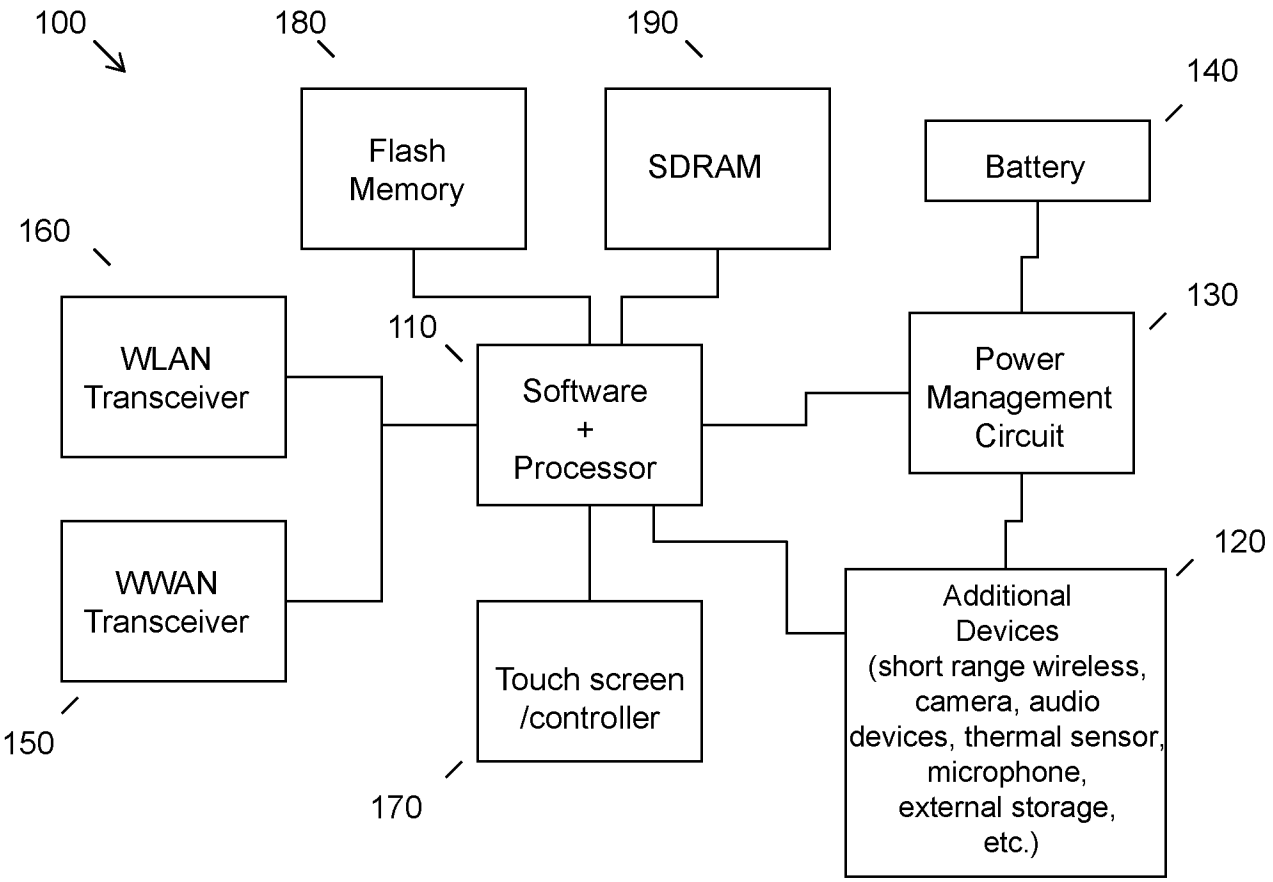
FIG. 1 illustrates an example of information handling device circuitry.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

Wearable devices are very convenient for continuous data collection and allow a user to track and store activity and/or fitness data. Conventionally, wearable devices are paired (e.g., through a wireless connection, etc.) with another mobile device (e.g., smart phone, tablet, etc.) so that transmitted data from the wearable device can be viewed and manipulated on the other device. This pairing is especially useful if the wearable device does not have an integrated display screen, or has a small display only capable of providing a limited amount of information. For example, a dedicated fitness tracker (e.g., Fitbit®, etc.) can monitor and store a user's step data for a particular week, which can then be displayed to a user in graph form using the display of the user's smart phone.

Situations often arise where a wearable device is not able to track user activity data, for example, a user may have forgotten to put the wearable device on before engaging in an activity, the wearable device may have run out of battery power at some point during the day, and the like. Situations where activity data goes untracked may cause frustration for users (e.g., for those dedicated to monitoring their fitness activity, for those engaged in remote fitness competitions, etc.).

Existing solutions require a user to find their wearable device and put it on if they forgot to wear it or charge it if the battery has run down. These solutions are not only cumbersome and time-consuming but they may be impractical. For example, if a user has traveled a long distance to engage in an activity (e.g., driven to the gym, etc.), then it would be impractical for them to travel back home just to place the fitness tracker back on. Additionally, even after a user has found or recharged their wearable device, any data associated with an activity a user engaged in while not wearing the wearable device is lost. Another solution allows a user to input an estimation value associated with the activity, for example, if the user is tracking steps, the user may put in an estimated number of steps. However, such a solution is highly inaccurate. Additionally, it requires the user to perform extra steps to input the estimation.

Accordingly, an embodiment provides a method for prompting a user to provide additional information related to the activity. In an embodiment, an indication may be received that a user is engaging in an activity (e.g., walking, running, another physical activity, etc.). An embodiment may then determine whether data related to the activity is associated with a tracking application. Responsive to determining that the activity data is being tracked, an embodiment may prompt a user to provide additional information related to the activity. Such a method may enable a user to provide additional data related to the activity.

Additionally, an embodiment provides a method for estimating the data related to an activity when the activity is not being tracked by a device that normally tracks the activity information. For example, an embodiment may determine that a dedicated activity tracker (e.g., a Fitbit®, etc.) may not be tracking activity data (e.g., because the user forgot to put it on, the dedicated activity tracker battery has died, etc.). Responsive to this determination, an embodiment may provide an estimation of activity data (e.g., an embodiment may estimate how many calories a user burned while engaging in an activity, etc.). A user may then verify this estimated data prior to incorporating the data into another data accumulation set (e.g., a daily calorie count, daily step count, etc.). Such a method may enable a user to keep track of their activity data regardless of whether or not a primary activity tracking device is tracking activity data.

The illustrated example embodiments will be best understood by reference to the figures. The following description is intended only by way of example, and simply illustrates certain example embodiments.

While various other circuits, circuitry or components may be utilized in information handling devices, with regard to smart phone and/or tablet circuitry 100, an example illustrated in FIG. 1 includes a system on a chip design found for example in tablet or other mobile computing platforms. Software and processor(s) are combined in a single chip 110. Processors comprise internal arithmetic units, registers, cache memory, busses, I/O ports, etc., as is well known in the art. Internal busses and the like depend on different vendors, but essentially all the peripheral devices (120) may attach to a single chip 110. The circuitry 100 combines the processor, memory control, and I/O controller hub all into a single chip 110. Also, systems 100 of this type do not typically use SATA or PCI or LPC. Common interfaces, for example, include SDIO and I2C.

There are power management chip(s) 130, e.g., a battery management unit, BMU, which manage power as supplied, for example, via a rechargeable battery 140, which may be recharged by a connection to a power source (not shown). In at least one design, a single chip, such as 110, is used to supply BIOS like functionality and DRAM memory.

System 100 typically includes one or more of a WWAN transceiver 150 and a WLAN transceiver 160 for connecting to various networks, such as telecommunications networks and wireless Internet devices, e.g., access points. Additionally, devices 120 are commonly included, e.g., an image sensor such as a camera, audio capture device such as a microphone, a thermal sensor, etc. System 100 often includes a touch screen 170 for data input and display/rendering. System 100 also typically includes various memory devices, for example flash memory 180 and SDRAM 190.

Figure 2:
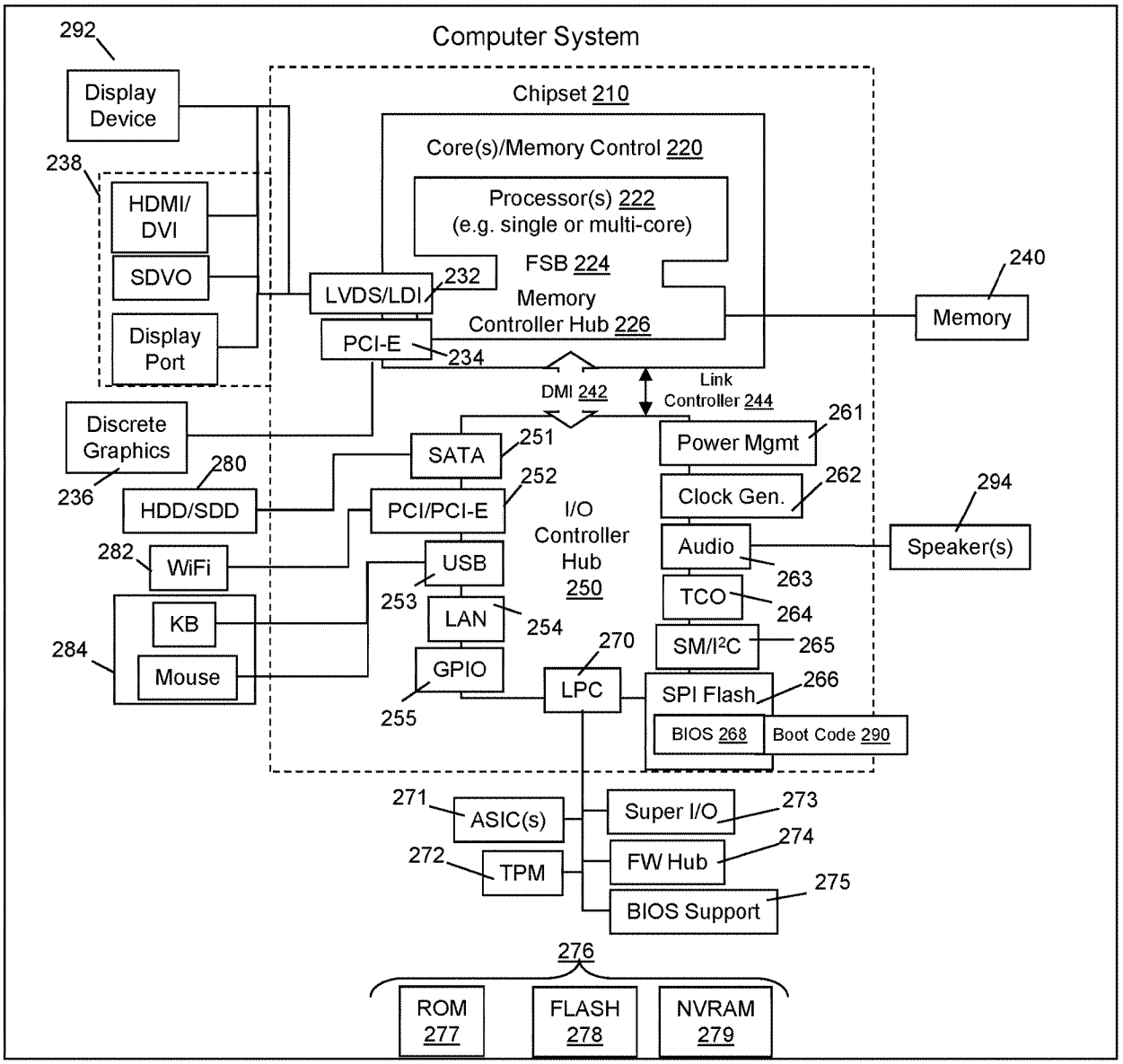
FIG. 2 illustrates another example of information handling device circuitry.

FIG. 2 depicts a block diagram of another example of information handling device circuits, circuitry or components. The example depicted in FIG. 2 may correspond to computing systems such as the THINKPAD series of personal computers sold by Lenovo (US) Inc. of Morrisville, N.C., or other devices. As is apparent from the description herein, embodiments may include other features or only some of the features of the example illustrated in FIG. 2.

The example of FIG. 2 includes a so-called chipset 210 (a group of integrated circuits, or chips, that work together, chipsets) with an architecture that may vary depending on manufacturer (for example, INTEL, AMD, ARM, etc.). INTEL is a registered trademark of Intel Corporation in the United States and other countries. AMD is a registered trademark of Advanced Micro Devices, Inc. in the United States and other countries. ARM is an unregistered trademark of ARM Holdings plc in the United States and other countries. The architecture of the chipset 210 includes a core and memory control group 220 and an I/O controller hub 250 that exchanges information (for example, data, signals, commands, etc.) via a direct management interface (DMI) 242 or a link controller 244. In FIG. 2, the DMI 242 is a chip-to-chip interface (sometimes referred to as being a link between a "northbridge" and a "southbridge"). The core and memory control group 220 include one or more processors 222 (for example, single or multi-core) and a memory controller hub 226 that exchange information via a front side bus (FSB) 224; noting that components of the group 220 may be integrated in a chip that supplants the conventional "northbridge" style architecture. One or more processors 222 comprise internal arithmetic units, registers, cache memory, busses, I/O ports, etc., as is well known in the art.

In FIG. 2, the memory controller hub 226 interfaces with memory 240 (for example, to provide support for a type of RAM that may be referred to as "system memory" or "memory"). The memory controller hub 226 further includes a low voltage differential signaling (LVDS) interface 232 for a display device 292 (for example, a CRT, a flat panel, touch screen, etc.). A block 238 includes some technologies that may be supported via the LVDS interface 232 (for example, serial digital video, HDMI/DVI, display port). The memory controller hub 226 also includes a PCI-express interface (PCI-E) 234 that may support discrete graphics 236.

In FIG. 2, the I/O hub controller 250 includes a SATA interface 251 (for example, for HDDs, SDDs, etc., 280), a PCI-E interface 252 (for example, for wireless connections 282), a USB interface 253 (for example, for devices 284 such as a digitizer, keyboard, mice, cameras, phones, microphones, storage, other connected devices, etc.), a network interface 254 (for example, LAN), a GPIO interface 255, a LPC interface 270 (for ASICs 271, a TPM 272, a super I/O 273, a firmware hub 274, BIOS support 275 as well as various types of memory 276 such as ROM 277, Flash 278, and NVRAM 279), a power management interface 261, a clock generator interface 262, an audio interface 263 (for example, for speakers 294), a TCO interface 264, a system management bus interface 265, and SPI Flash 266, which can include BIOS 268 and boot code 290. The I/O hub controller 250 may include gigabit Ethernet support.

The system, upon power on, may be configured to execute boot code 290 for the BIOS 268, as stored within the SPI Flash 266, and thereafter processes data under the control of one or more operating systems and application software (for example, stored in system memory 240). An operating system may be stored in any of a variety of locations and accessed, for example, according to instructions of the BIOS 268. As described herein, a device may include fewer or more features than shown in the system of FIG. 2.

Information handling device circuitry, as for example outlined in FIG. 1 or FIG. 2, may be used in devices such as tablets, smart phones, wearable devices, personal computer devices generally, and/or electronic devices which may include fitness tracking and biometric monitoring software that may track and log user activity and biometric data. For example, the circuitry outlined in FIG. 1 may be implemented in a tablet or smart phone embodiment, whereas the circuitry outlined in FIG. 2 may be implemented in a personal computer embodiment.

Figure 3:
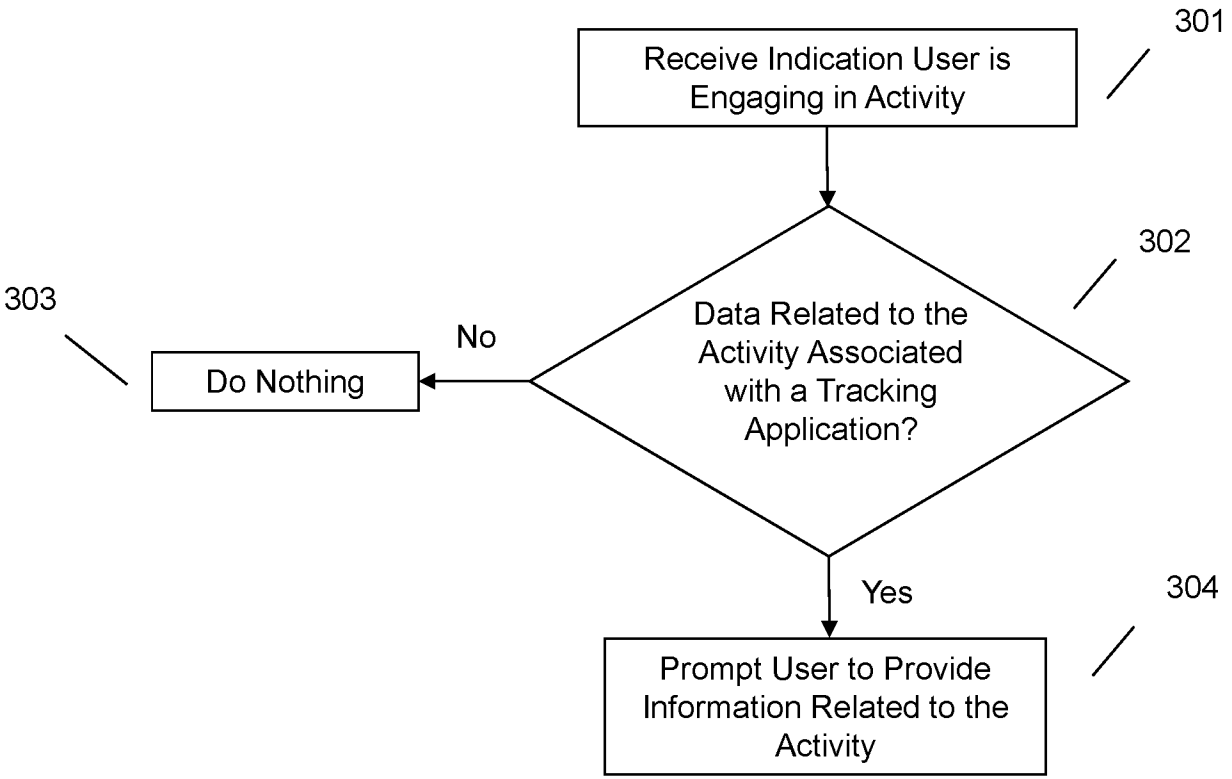
FIG. 3 illustrates an example method of prompting a user to provide information related to an activity.

Referring now to FIG. 3, an embodiment may prompt a user to provide information related to an activity responsive to determining that the activity is associated with a tracking application. At 301, an embodiment may receive an indication that a user is engaging in an activity. In an embodiment, the activity may be virtually any activity requiring some level of physical exertion (e.g., walking, running, playing a sport, etc.). Alternatively, the activity may be any activity that is related to health monitoring, for example, an activity including consuming calories, an activity burning calories, and the like.

In an embodiment, the indication may be an identification of a location. The location may be a location that the device knows to be associated with an activity. For example, a user may frequently play tennis at a particular tennis court. If an embodiment identifies that the user is at a tennis court (e.g., using GPS positioning, social media tags, other geolocation techniques, etc.), an embodiment may infer that the user is engaging in the play of tennis. In another embodiment, the indication may simply be an indication that a user is moving (e.g., walking, running, etc.). For example, an embodiment may differentiate between user vehicular movement and user ambulatory movement by using a combination of sensors such as GPS, accelerometers, gyroscopes, etc. More particularly, an embodiment may identify that the acceleration and gyroscopic data received during the movement period corresponds to known acceleration and gyroscopic data associated with ambulatory movements such as walking and running.

At 302, an embodiment may determine whether data related to the activity is associated with a tracking application. In an embodiment, data related to the activity may include caloric data (e.g., calories burned performing the activity, etc.), exercise data (e.g., step data, distance data, repetition data, etc.), biometric data (e.g., heart rate, etc.), and the like. In an embodiment, a tracking application may correspond to software incorporated on a device (e.g., a wearable device, smart phone, tablet, etc.) that enables the device to detect, track, and log activity data. In an embodiment, a user may have multiple devices from which one of the devices is primarily responsible for tracking user activity data. For example, a user may normally carry a smart phone and wear a wearable fitness tracker (e.g., Fitbit®, etc.), from which the wearable fitness tracker primarily tracks the activity data.

If an embodiment determines that data related to the activity is not associated with a tracking application at 302, an embodiment may do nothing at 303. However, responsive to determining, at 302, that data related to the activity is tracked by a tracking application, an embodiment may prompt, at 304, a user to provide information related to the activity. In an embodiment, the prompting may be done irrespective of whether a primary fitness tracking device is missing or not. For example, the prompting may be done if an embodiment determines that a user has both, their smart phone and their wearable device, or just one of the two. An embodiment may prompt a user through a variety of different methods such as through a visual notification, an audible notification, a combination thereof, and the like. In an embodiment, the information related to the activity may be virtually any information associated with the activity such as the location of the activity, items available for purchase at the activity location, time of the activity, and the like. The information related to the activity may include what the person ate, how many calories were consumed, what activity the user was performing, how long the user performed the activity, and the like.

An embodiment may determine a location of an activity and access data associated with the location. For example, an embodiment may determine that a user was at a health club and may obtain access to a menu of a restaurant at the club. An embodiment may then prompt the user to input some data associated with that location. For example, an example visual prompt may be, "I see you were at The Health Club at lunch time, would you like to add a meal from that menu to your daily calorie counter?" In such a scenario, the detecting agent may be a device (e.g., such as a mobile device, smart car, etc.) or any other service that can identify location (e.g., credit card purchase data, social media data, etc.). Responsive to receiving selection input (e.g., touch input, stylus input, voice input, etc.) from a user, an embodiment may perform a corresponding downstream function (e.g., responsive to receiving input that a user had a smoothie at the health club, an embodiment may incorporate the calories associated with a smoothie to a user's daily calorie count, etc.).

Figure 4:
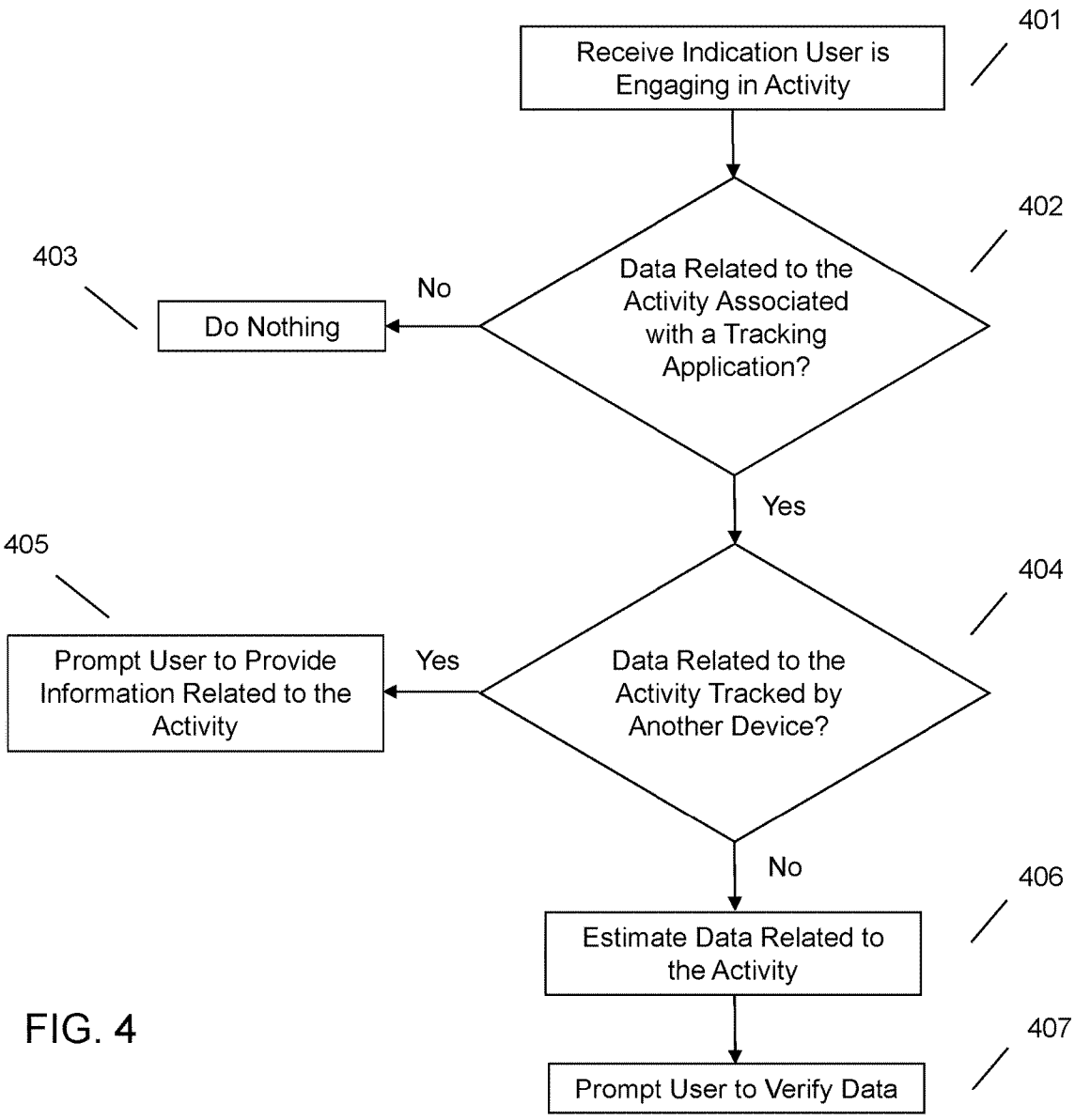
FIG. 4 illustrates an example method of estimating activity data when the activity data is not tracked by a device that usually tracks activity data.

Referring now to FIG. 4, an embodiment may estimate data related to the activity subsequent to determining that the data related to the activity is not being tracked by another device that normally tracks the activity information. Steps 401-403 are similar to steps 301-303, which have been elaborated upon above and therefore will not be repeated here. Referring now to step 404, responsive to determining that data related to the activity is not tracked by another device, an embodiment may estimate, at 406, data related to the activity. For example, an embodiment may identify that a wearable device (e.g., smart watch, dedicated fitness tracker, etc.) is no longer in communication with another device of a user (e.g., a smart phone, tablet, etc.). The devices may no longer be in communication for a variety of reasons such as an increase in proximate distance between the devices (e.g., a user forgot to put on their wearable device when leaving somewhere but remembered to bring their smart phone, etc.), loss of power of the wearable device (e.g., the battery of the wearable device ran out, etc.), interruption of a wireless connection between the devices, and the like. Responsive to determining that the device generally responsible for activity tracking is no longer tracking the information, an embodiment may estimate the activity data. The estimation of activity data may be done using one, or a combination of, the methods described below.

In an embodiment, the estimation may involve accessing previously gathered activity data associated with the activity. For example, a user may have previously worn a wearable device while playing a game of tennis, during which time activity data associated with the tennis game may have been tracked and logged (e.g., a user burned 500 calories during the tennis game, took 1000 steps during the game, etc.). Responsive to determining that the user is at a tennis court again, an embodiment may estimate that a user will generate a similar amount of activity data. As another example, based upon previously obtained activity data associated with movement of a user between two locations (e.g., a user walking from work to a coffee shop, etc.) an embodiment may estimate activity data that corresponds to that movement (e.g., an embodiment may estimate that a user took 500 steps to traverse the distance between the two locations based upon previously identifying, using the wearable device, that a user took 500 steps to traverse the distance between those locations, etc.). In an embodiment, a database comprising additional types of activity data that may correspond to the estimated activity data may be accessed. For example, if an embodiment estimates that a user took 500 steps to traverse the distance between two locations, an embodiment may access a database of additional activity metrics that may correspond to the estimated step amount (e.g., 500 steps may correspond to 30 calories, 500 steps may correspond to one-quarter mile, etc.).

An embodiment may also estimate the data by using other sensors that provide information that can be used to determine the desired data. For example, an embodiment may determine a distance between a starting point, for example, identified using a GPS sensor, and an ending point. An embodiment may also identify the time it took for the user to traverse the distance between the starting point and ending point, for example, using a timer or other time based sensor. An embodiment may then determine that in order to traverse the distance in the identified time the user had to be traveling at a particular speed. The system may then determine the activity data associated with that speed and the identified time.

In an embodiment, additional contextual data sources (e.g., calendar data, event data, other types of contextual data associated with the user and/or the activity, etc.) may be accessed and utilized to make the estimation. For example, if a user frequently attends varied workout programs at a gym, an embodiment may access a user's calendar data and/or gym program data to predict an activity a user may be engaged in on a particular day (e.g., a user may usually attend a spin class on Monday, a yoga class on Tuesday, lift weights on Wednesday, etc.). Responsive to determining that the user is at the gym on a particular day of the week, an embodiment may predict the activity a user is engaged in and estimate data associated with that activity based upon previously received data for the activity. For example, a user may have previously worn a wearable device while attending a Monday spin class, during which time activity data associated with the spin class may have been tracked and logged (e.g., 500 calories burned during the class, etc.). Responsive to determining that the user is at the gym on a Monday, an embodiment may predict that a user is attending a spin class and estimate that the user will burn about 500 calories.

In an embodiment, time data associated with how long a user engaged in the physical activity may also be utilized in the estimation. For example, if an embodiment previously identified that a user burned 500 calories at a tennis court over the course of 1 hour, an embodiment may estimate that a user burns 1000 calories at a tennis court if the user is at the court for 2 hours. An embodiment may be able to determine the length of time a user engaged in an activity, for example, by using time stamp data in conjunction with GPS data to identify the time a user arrived and left a particular location. An embodiment may also be able to determine the length of time a user is engaged in ambulatory movement by identifying the time the ambulatory movement is determined to have started and stopped (e.g., using accelerometer data, gyroscopic data, a combination thereof, etc.).

In an embodiment, the estimation may involve accessing data related to the activity from another user's device. In many instances, a user may be engaged in a substantially similar physical activity as another person. In such a situation, over the course of the activity, activity data accumulated by both users is likely to be very similar. Therefore, an embodiment may be able to obtain activity data compiled by the other user's device in order to estimate a user's own activity data for that activity. For example, if a user plays a game of tennis with a friend who is wearing a fitness tracker during the match, an embodiment may be able to access data obtained by the friend's fitness tracker to estimate the activity data that a user themselves compiled because the user engaged in a substantially similar activity as the friend. The system may be able to determine which user's device to access based upon a proximity signal, for example, wireless signal, radio frequency identification signal, and the like.

At 407, an embodiment may prompt a user to verify the estimated activity data. In an embodiment, all estimated activity data not directly determined by the device generally responsible for tracking activity data (e.g., the wearable device, etc.), may be marked as unverified. Unverified data may be held, for example, in a queue and may not be incorporated into additional data compilations. For example, unverified step data and unverified calorie data may not be incorporated into a user's daily total step and caloric accumulations. An embodiment may prompt a user (e.g., through a visual notification, audible notification, a combination thereof, etc.) to verify the unverified data. For example, an embodiment may ask (e.g., through a notification message, etc.) a user to verify that the 500 calories an embodiment estimated a user burned while at a tennis court is an appropriate estimation. Responsive to receiving user input (e.g., touch input, voice input, stylus input, etc.) that the estimation is accurate, an embodiment may then mark the estimated data as verified and may automatically incorporate the verified data into other data accumulations. An embodiment may also allow a user to adjust the estimated data. For example, a user may provide input changing the amount of calories burned at the tennis court from 500 to 200. The adjusted data may be marked as verified and may then be automatically incorporated into other data accumulations.

Responsive to determining, at 404, that data related to the activity is tracked by another device, an embodiment may prompt, at 405, a user to provide information related to the activity. As step 405 is similar to step 304, which has been elaborated upon, further description will not be presented here.

The various embodiments described herein thus represent a technical improvement to conventional activity tracking techniques. Using the techniques described herein, an embodiment may receive an indication that a user is engaging in an activity and may prompt a user to provide additional information related to the activity. Additionally, responsive to determining that a primary activity tracking device is not in proximate possession of a user, an embodiment may estimate the activity data. A user may then verify the estimated activity data prior to incorporating the data into another data accumulation set. Such techniques enable a device to keep track of a user's activity data regardless of whether or not a primary activity tracking device is tracking the user's activity.

As will be appreciated by one skilled in the art, various aspects may be embodied as a system, method or device program product. Accordingly, aspects may take the form of an entirely hardware embodiment or an embodiment including software that may all generally be referred to herein as a "circuit," "module" or "system." Furthermore, aspects may take the form of a device program product embodied in one or more device readable medium(s) having device readable program code embodied therewith.

It should be noted that the various functions described herein may be implemented using instructions stored on a device readable storage medium such as a non-signal storage device that are executed by a processor. A storage device may be, for example, a system, apparatus, or device (e.g., an electronic, magnetic, optical, electromagnetic, infrared, or semiconductor system, apparatus, or device) or any suitable combination of the foregoing. More specific examples of a storage device/medium include the following: a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a storage device is not a signal and "non-transitory" includes all media except signal media.

Program code embodied on a storage medium may be transmitted using any appropriate medium, including but not limited to wireless, wireline, optical fiber cable, RF, et cetera, or any suitable combination of the foregoing.

Program code for carrying out operations may be written in any combination of one or more programming languages. The program code may execute entirely on a single device, partly on a single device, as a stand-alone software package, partly on single device and partly on another device, or entirely on the other device. In some cases, the devices may be connected through any type of connection or network, including a local area network (LAN) or a wide area network (WAN), or the connection may be made through other devices (for example, through the Internet using an Internet Service Provider), through wireless connections, e.g., near-field communication, or through a hard wire connection, such as over a USB connection.

Example embodiments are described herein with reference to the figures, which illustrate example methods, devices and program products according to various example embodiments. It will be understood that the actions and functionality may be implemented at least in part by program instructions. These program instructions may be provided to a processor of a device, a special purpose information handling device, or other programmable data processing device to produce a machine, such that the instructions, which execute via a processor of the device implement the functions/acts specified.

It is worth noting that while specific blocks are used in the figures, and a particular ordering of blocks has been illustrated, these are non-limiting examples. In certain contexts, two or more blocks may be combined, a block may be split into two or more blocks, or certain blocks may be re-ordered or re-organized as appropriate, as the explicit illustrated examples are used only for descriptive purposes and are not to be construed as limiting.

As used herein, the singular "a" and "an" may be construed as including the plural "one or more" unless clearly indicated otherwise.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Thus, although illustrative example embodiments have been described herein with reference to the accompanying figures, it is to be understood that this description is not limiting and that various other changes and modifications may be affected therein by one skilled in the art without departing from the scope or spirit of the disclosure.

What is claimed is:

1. A method, comprising:

receiving, at an information handling device, an indication that a user is engaging in an activity corresponding to an activity having data tracked via an activity tracking application;

identifying that the activity tracking application is not tracking the user during the activity, wherein the identifying comprises detecting loss of communication between the device comprising the activity tracking application and another device associated with and within a proximity of the user;

estimating, responsive to the identifying, the data tracked via the activity tracking application and corresponding to the activity and marking the estimated data as unverified data, wherein the estimated data is held in a queue until the estimated data is verified; and verifying the estimated data corresponding to the activity and incorporating the estimated data into data compilations after the verification, wherein the verifying comprises at least querying the user to verify at least a portion of the unverified data.

2. The method of claim 1, wherein the data comprises at least one of: calorie data, biometric data, and exercise data.

3. The method of claim 1, wherein the receiving comprises determining a nature of the activity by identifying a location of the activity and accessing data associated with the location.

4. The method of claim 1, wherein the estimating comprises accessing previously gathered activity data associated with the activity.

5. The method of claim 1, wherein the estimating comprises accessing data related to the activity from the another user device.

6. The method of claim 1, wherein the receiving an indication comprises receiving location information associated with the activity.

7. The method of claim 1, wherein the loss of communication is due to one or more of: an increase in proximate distance between the tracking device and the another device, loss of power of the tracking device, and wireless interruptions between the tracking device and the another device.

8. An information handling device, comprising:

a processor;

a memory device that stores instructions executable by the processor to:

receive an indication that a user is engaging in an activity corresponding to an activity having data tracked via an activity tracking application;

identify that the activity tracking application is not tracking the user during the activity, wherein the identifying comprises detecting loss of communication between the device comprising the activity tracking application and another device associated with and within a proximity of the user;

estimate, responsive to the identifying, the data tracked via the activity tracking application and corresponding to the activity and marking the estimated data as unverified data, wherein the estimated data is held in a queue until the estimated data is verified; and verify the estimated data corresponding to the activity and incorporating the estimated data into data compilations after the verification, wherein to verify comprises at least querying the user to verify at least a portion of the unverified data.

9. The information handling device of claim 8, wherein the data comprises at least one of: calorie data, biometric data, and exercise data.

10. The information handling device of claim 8, wherein the instructions executable by the processor to receive comprise instructions executable by the processor to determine a nature of the activity by identifying a location of the activity and accessing data associated with the location.

11. The information handling device of claim 8, wherein the instructions executable by the processor to estimate comprise instructions executable by the processor to access previously gathered activity data associated with the activity.

12. The information handling device of claim 8, wherein the instructions executable by the processor to estimate comprise instructions executable by the processor to access data related to the activity from the another user device.

13. The information handling device of claim 8, wherein the instructions are further executable by the processor to:

mark the estimated data as unverified data; and query the user to verify the data marked as unverified.

14. The information handling device of claim 8, wherein the loss of communication is due to one or more of: an increase in proximate distance between the tracking device and the another device, loss of power of the tracking device, and wireless interruptions between the tracking device and the another device.

15. A product, comprising:

a storage device that stores code, the code being executable by a processor and comprising:

code that receives an indication that a user is engaging in an activity corresponding to an activity having data tracked via an activity tracking application;

code that identifies that the activity tracking application is not tracking the user during the activity, wherein the identifying comprises detecting loss of communication between the device comprising the activity tracking application and another device associated with and within a proximity of the user;

code that estimates, responsive to the identifying, the data tracked via the activity tracking application and corresponding to the activity and marking the estimated data as unverified data, wherein the estimated data is held in a queue until the estimated data is verified; and code that verifies the estimated data corresponding to the activity and incorporating the estimated data into data compilations after the verification, wherein the code that verifies comprises code that at least queries the user to verify at least a portion of the unverified data.

* * * * *